US009270045B2

(12) United States Patent
Kimura

(10) Patent No.: US 9,270,045 B2
(45) Date of Patent: Feb. 23, 2016

(54) CONNECTOR

(71) Applicant: Japan Aviation Electronics Industry, Limited, Tokyo (JP)

(72) Inventor: Kousuke Kimura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 4 days.

(21) Appl. No.: 14/324,783

(22) Filed: Jul. 7, 2014

(65) Prior Publication Data

US 2015/0044914 A1 Feb. 12, 2015

(30) Foreign Application Priority Data

Aug. 7, 2013 (JP) ..... 2013-164567

(51) Int. Cl.
*H01R 12/00* (2006.01)
*H01R 13/41* (2006.01)
*H01R 12/71* (2011.01)

(52) U.S. Cl.
CPC ..... *H01R 13/41* (2013.01); *H01R 12/716* (2013.01)

(58) Field of Classification Search
CPC .. H01R 12/57; H01R 12/585; H01R 13/6315; H01R 13/748; H01R 23/725
USPC ..... 439/74, 83, 247, 248, 637, 342, 733.1
See application file for complete search history.

(56) References Cited

U.S. PATENT DOCUMENTS

| | | | | |
|---|---|---|---|---|
| 4,842,528 | A * | 6/1989 | Frantz | H01R 9/091 439/733.1 |
| 5,112,233 | A * | 5/1992 | Lybrand | H01R 13/41 439/733.1 |
| 5,727,957 | A * | 3/1998 | Hashimoto | H01R 12/57 439/733.1 |
| 6,652,294 | B1 * | 11/2003 | Zhang | H01R 12/57 439/736 |
| 6,851,986 | B2 * | 2/2005 | Zhao | H01R 13/2435 439/595 |
| 8,152,548 | B2 | 4/2012 | Masuda et al. | |
| 8,944,829 | B2 * | 2/2015 | Ho | H01R 13/04 439/79 |
| 2006/0019506 | A1 | 1/2006 | Harasawa | |

FOREIGN PATENT DOCUMENTS

| | | | |
|---|---|---|---|
| JP | 2004-119050 | A | 4/2004 |
| JP | 2005-108765 | A | 4/2005 |
| JP | 2005-209501 | A | 8/2005 |
| JP | 2010-272320 | A | 12/2010 |

* cited by examiner

*Primary Examiner* — Hien Vu
(74) *Attorney, Agent, or Firm* — Collard & Roe, P.C.

(57) ABSTRACT

A connector comprises a housing and a plurality of contacts. Each of the contacts has one or more first sets and one or more second sets. The first set includes two first press-fit portions which protrude oppositely to each other in a first direction. The second set includes two second press-fit portions which protrude oppositely to each other in a second direction perpendicular to the first direction. The first press-fit portions and the second press-fit portions are press-fit in the housing.

4 Claims, 8 Drawing Sheets

CONNECTOR

CROSS REFERENCE TO RELATED APPLICATIONS

An applicant claims priority under 35 U.S.C. §119 of Japanese Patent Application No. JP2013-164567 filed Aug. 7, 2013.

BACKGROUND OF THE INVENTION

This invention relates to a connector comprising a contact and a housing and, in particular, to a connector where the contact is press-fit in the housing.

For example, this type of connector is disclosed in the second embodiment shown in FIGS. 5 to 10 of JP-A 2010-272320 (Patent Document 1), the content of which is incorporated herein by reference.

As shown in FIG. 12, Patent Document 1 discloses a first connector 910 (mating connector) and a second connector 920 (connector) having so-called floating structure. The second connector 920 comprises a stationary housing 922, a movable housing 924 and a plurality of contacts 926. The movable housing 924 is supported by the contacts 926 so as to be movable, relative to the stationary housing 922, in a plane perpendicular to a mating direction.

In general, in a connector with floating structure, when its movable housing is moved in an orthogonal plane perpendicular to a mating direction, various stresses directed in various directions on this orthogonal plane are applied to its contact. Accordingly, supporting position at which the contact supports the movable housing might be shifted. In even worse cases, the contact might come off the supporting position.

Even in a connector not having floating structure, a problem might be caused when stresses are similarly applied to its contact held by a housing. For example, when the aforementioned stresses are applied to the contact under a case where the connector is mounted on a circuit board and where an SMT portion of the contact is fixed to the circuit board by using solder, the stresses might make the contact be loosely held by the housing. As a result, the contact might be moved so that the solder, which fixes the SMT portion to the circuit board, might be cracked.

SUMMARY OF THE INVENTION

It is therefore an object of the present invention to provide a connector which can keep relation between a housing and a contact even if various stresses directed in various directions are applied to the contact.

One aspect of the present invention provides a connector comprising a housing and a plurality of contacts. Each of the contacts has one or more first sets and one or more second sets. The first set includes two first press-fit portions which protrude oppositely to each other in a first direction. The second set includes two second press-fit portions which protrude oppositely to each other in a second direction perpendicular to the first direction. The first press-fit portions and the second press-fit portions are press-fit in the housing.

According to one aspect of the present invention, since each of the contacts is provided with the first press-fit portions and the second press-fit portions, the relative relation between the housing and the contact is prevented from being broken even under a case where various stresses directed in various directions are applied to the contact in a plane defined by the first direction and the second direction.

An appreciation of the objectives of the present invention and a more complete understanding of its structure may be had by studying the following description of the preferred embodiment and by referring to the accompanying drawings.

Figure 1:
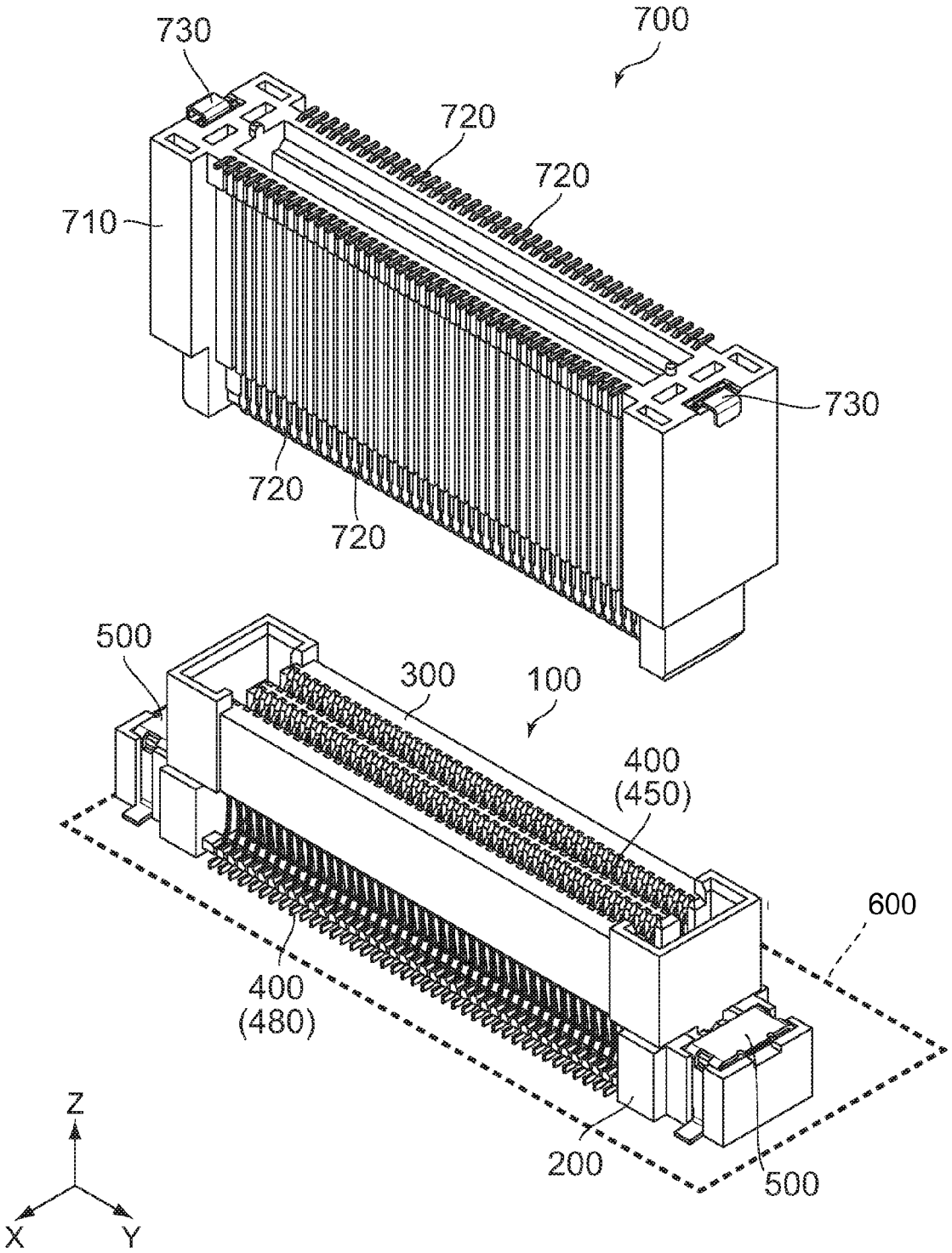
FIG. 1 is a perspective view showing a connector and a mating connector according to an embodiment of the present invention, wherein the connector and the mating connector are in an unmated state.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
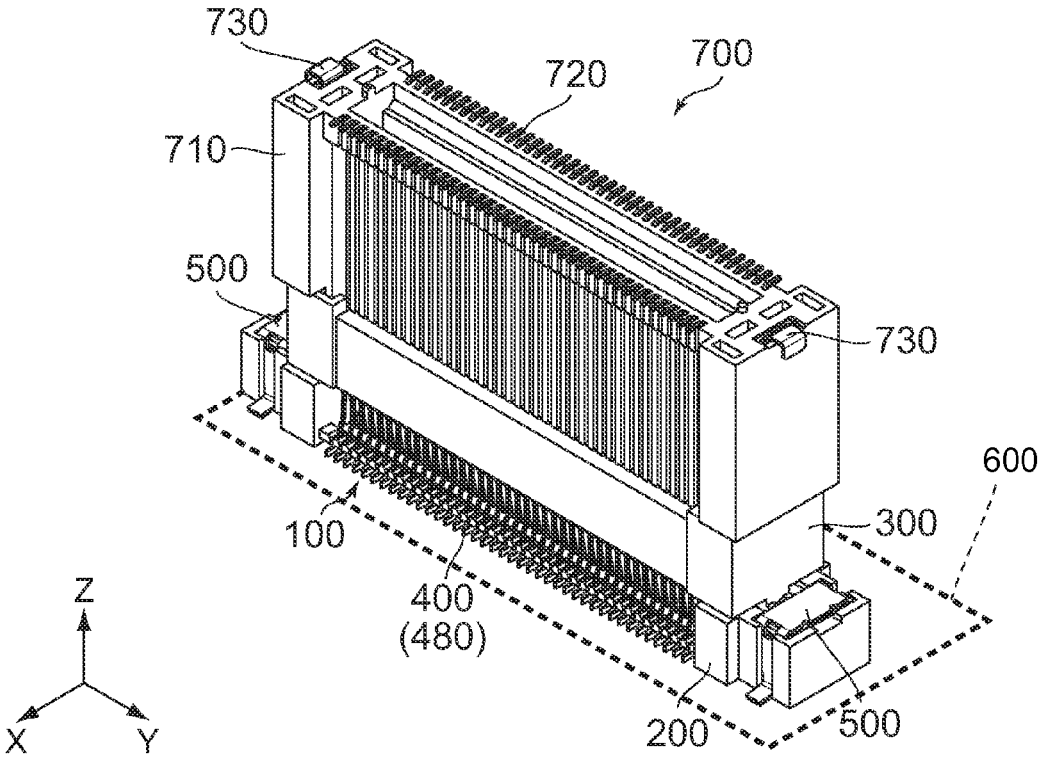
FIG. 2 is a perspective view showing the connector and the mating connector of FIG. 1, wherein the connector and the mating connector are in a mated state.
Figure 5:
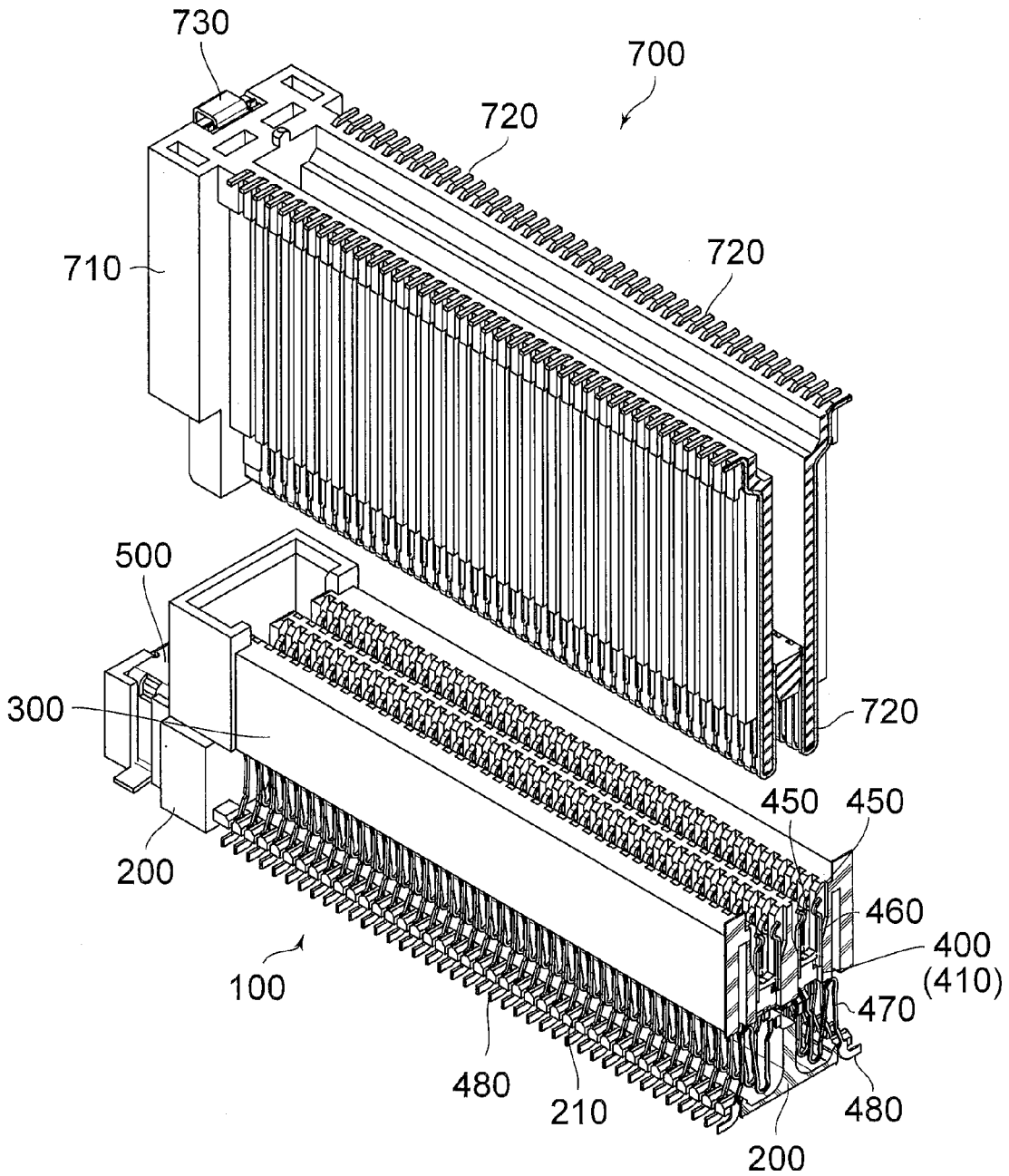
FIG. 5 is a partially cut-away, perspective view showing the connector and the mating connector of FIG. 1.
Figure 5:
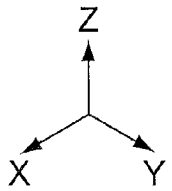

As shown in FIGS. 1, 2 and 5, a connector 100 according to an embodiment of the present invention has so-called floating structure. The connector 100 is mateable with a mating connector 700 along the Z-direction (a mating direction or an up-down direction).

Figure 3:
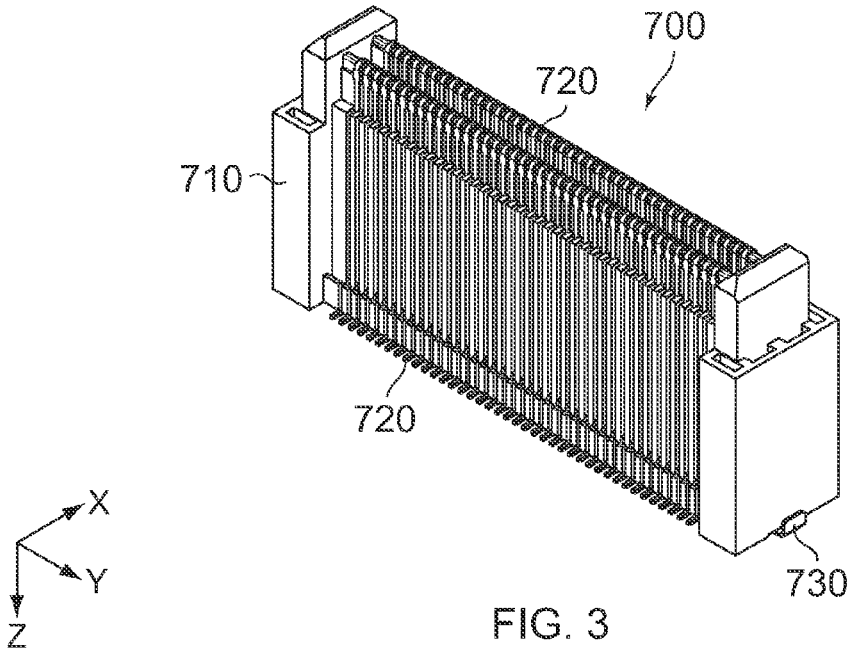
FIG. 3 is a perspective view showing the mating connector of FIG. 1.

As shown in FIGS. 1 to 3, the mating connector 700 comprises a mating housing 710 made of an insulator, a plurality of mating contacts 720 each made of a conductor and two mating holddowns 730 each made of a metal.

The mating contacts 720 are held by the mating housing 710. The mating contacts 720 are grouped into two groups. The mating contacts 720 of each group are arranged in one row along the Y-direction (second direction) perpendicular to the Z-direction. In other words, the mating contacts 720 are arranged in two rows. The rows of the mating contacts 720 are arranged to be symmetrical to each other with respect to an axis that passes through middle of the two rows in the X-direction and extends in the Z-direction. In other words, the mating contacts 720 of one of the rows have the respective shapes which can be obtained by rotating the mating contacts 720 of a remaining one of the rows by 180° around the axis extending in the Z-direction. The mating holddowns 730 are attached to the positive Z-side of the mating housing 710 to be located in the vicinities of opposite ends of the mating housing 710, respectively. When the mating connector 700 is mounted on a mating circuit board (not shown), the mating holddowns 730 are fixed to the mating circuit board (not shown) by using solder.

Figure 4:
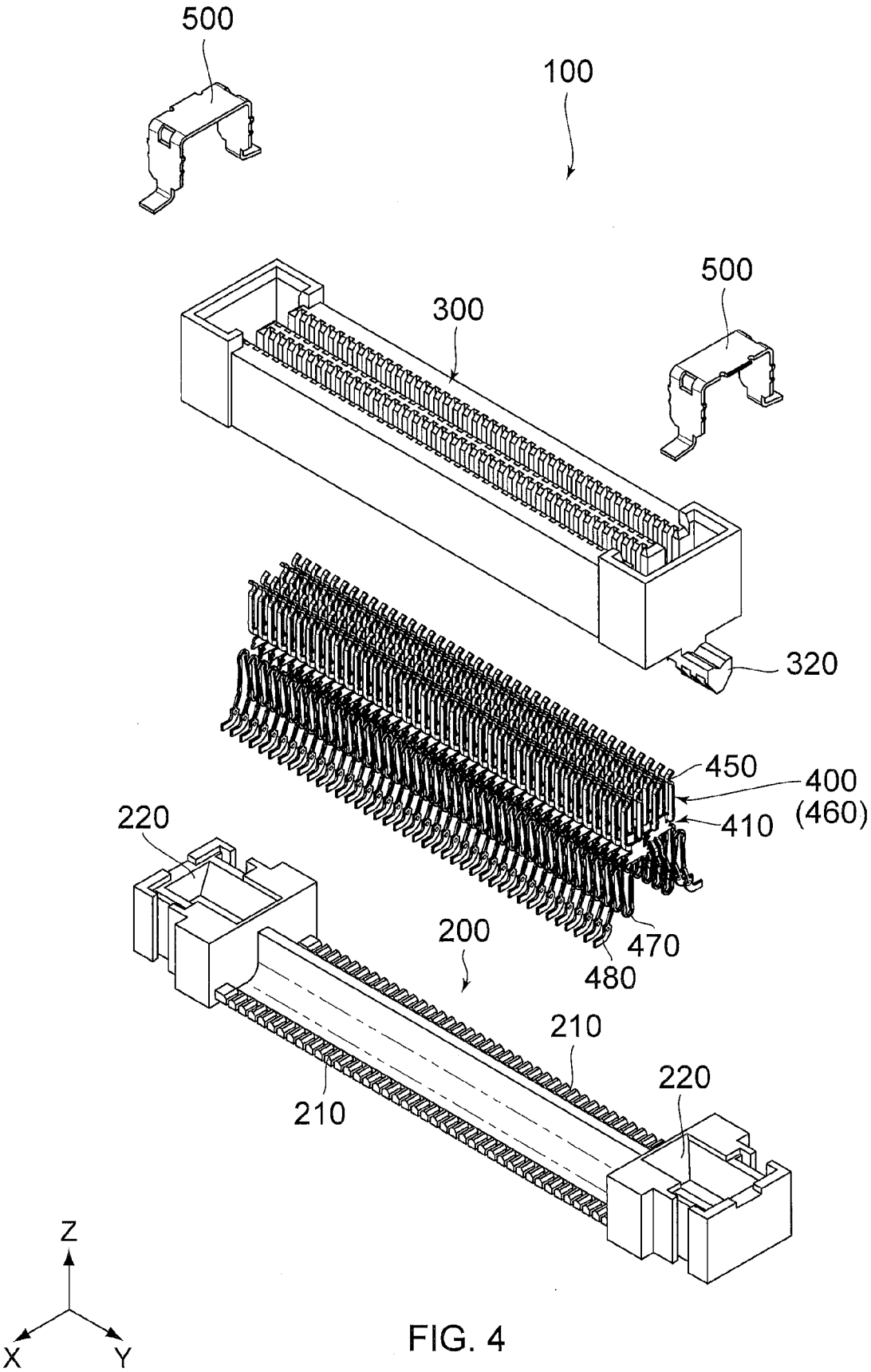
FIG. 4 is an exploded, perspective view showing the connector of FIG. 1.
Figure 6:
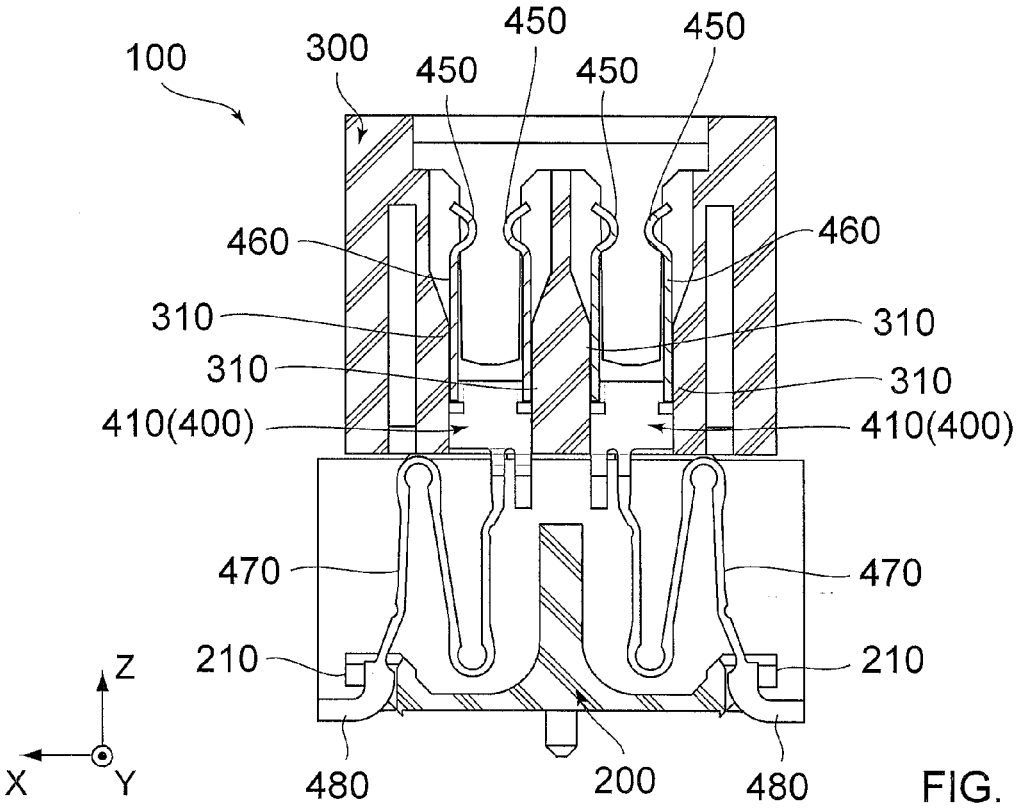
FIG. 6 is a cross-sectional view showing the connector of FIG. 1.

As shown in FIGS. 1, 4 and 6, the connector 100 comprises a stationary housing 200 made of an insulator, a movable housing 300 made of an insulator, a plurality of contacts 400 each made of a conductor and two holddowns 500 each made of a metal.

As can be seen from FIGS. 4 and 6, the stationary housing 200 has two alignment portions 210 and two receive portions 220. Each of the alignment portions 210 extends in the Y-direction. Each of the alignment portions 210 is formed with a plurality of ditches each of which extends in the X-direction (first direction) perpendicular to both the Z-direction and the Y-direction. Those ditches are arranged in the Y-direction to be in parallel with one another. The receive portions 220 are formed in the vicinities of opposite ends of the stationary housing 200 in the Y-direction, respectively, to be recessed in the negative Z-direction (downward).

As can be seen from FIGS. 4 and 6, the movable housing (housing) 300 has a plurality of holders 310 and two supported portions 320. As described later, the holders 310 are portions for holding the contacts 400, respectively. The holders 310 are grouped into two groups. The holders 310 of each group are provided to be arranged in the Y-direction. The supported portions 320 are provided in the vicinities of opposite ends of the movable housing 300 in the Y-direction, respectively. The supported portions 320 project in the negative Z-direction (downward) while extending outward in the Y-direction. The supported portions 320 are received in the receive portions 220 with margins, respectively, to be supported by the stationary housing 200 to be movable in the XY-plane (horizontal plane).

Figure 7:
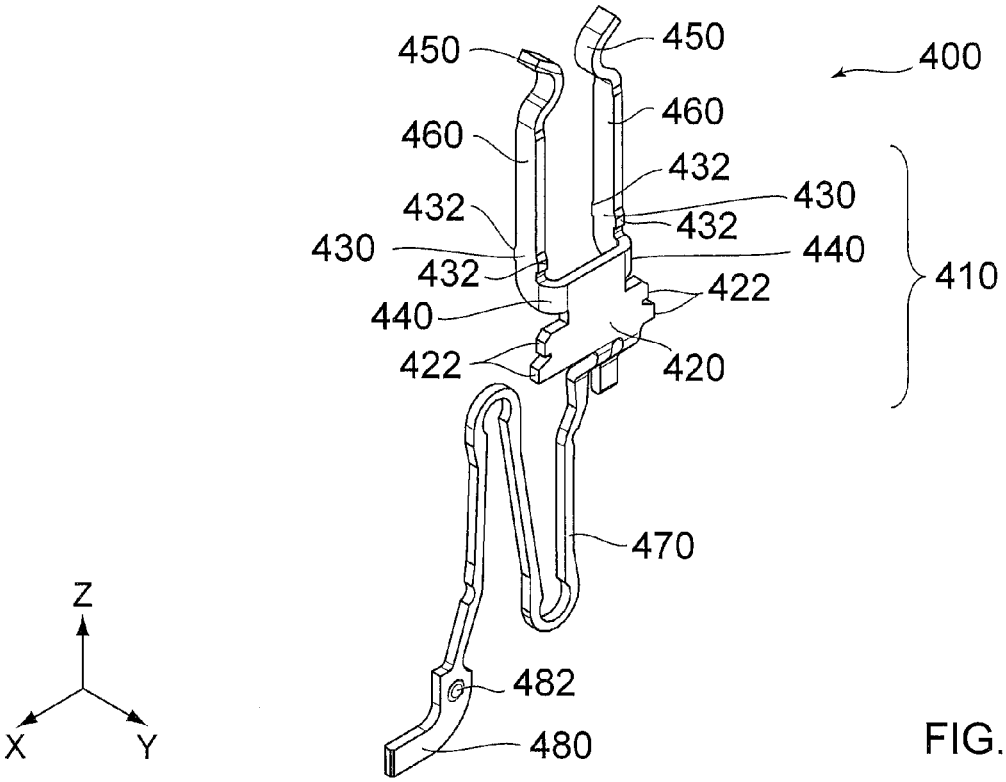
FIG. 7 is a front, perspective view showing a contact included in the connector of FIG. 1.

Referring to FIG. 4, the contacts 400 are arranged in two rows, namely, the positive X-side contact row and the negative X-side contact row. Each of the contact rows extends in the Y-direction. Referring to FIGS. 4 and 7, the contact 400 illustrated in FIG. 7 is included in the positive X-side contact row. The contact 400 included in the negative X-side contact row in FIG. 4, or the negative X-side contact 400, is different from the contact 400 shown in FIGS. 7 and 8, or the positive X-side contact 400, only in arrangement while having the same structure as the positive X-side contact 400. In detail, the negative X-side contact 400 can be obtained by rotating the positive X-side contact 400 by 180° around an axis extending in the Z-direction. In other words, the negative X-side contact 400 has a shape which is point symmetrical to that of the positive X-side contact 400 with respect to a point on the XY-plane. Accordingly, hereafter, explanation is made only about the positive X-side contact 400.

Figure 8:
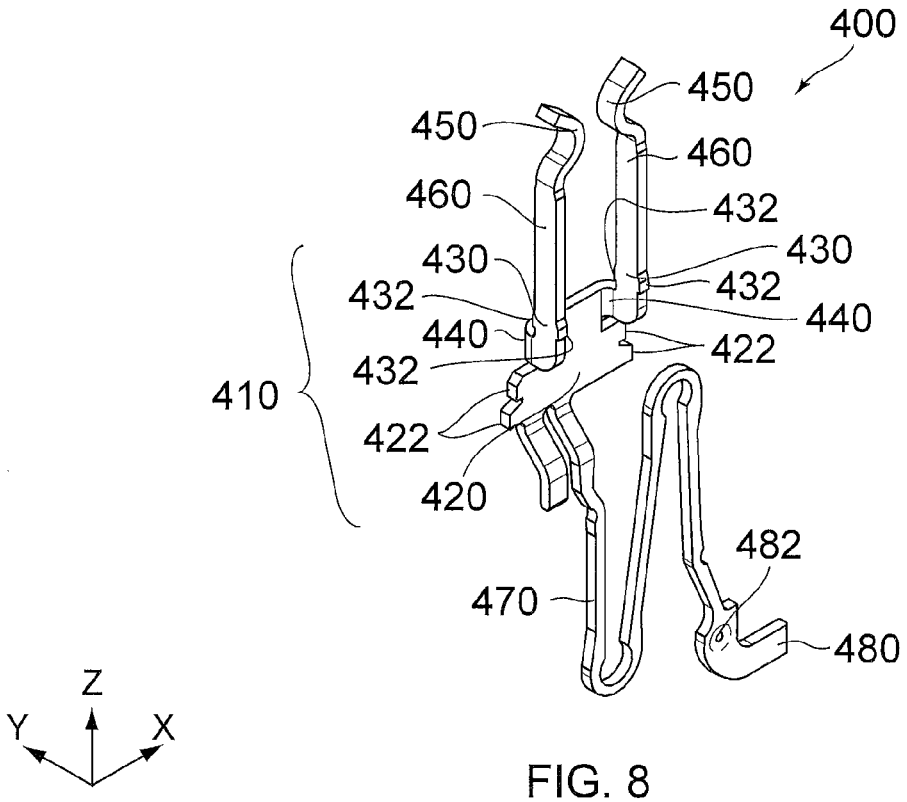
FIG. 8 is a rear, perspective view showing the contact of FIG. 7.

As shown in FIGS. 7 and 8, the contact 400 has a held portion 410, two contact support springs 460, two contact portions 450, a housing support spring 470 and a fixed portion 480. The held portion 410 is held by the holder 310 of the movable housing 300 (see FIG. 6). Each of the contact support springs 460 extends in the positive Z-direction (upward) from the held portion 410 to be resiliently deformable in the XZ-plane. The contact portions 450 are brought into contact with the mating contact 720 (see FIG. 5) when the connector 100 is mated with the mating connector 700 (see FIG. 5). The contact portions 450 are formed on the contact support springs 460, respectively, to be movable in the XZ-plane. The contact portions 450 face each other in the X-direction. The housing support spring 470 has an N-like shape to be resiliently deformable. The housing support spring 470 extends from the fixed portion 480 to couple the negative Z-side (lower side) of the held portion 410 and the fixed portion 480 with each other. As can be seen from the aforementioned structure, the held portion 410 according to the present embodiment is located between the housing support spring 470 and the contact support springs 460. In other words, the held portion 410 is located between two types of springs. The fixed portion 480 is fixed to a circuit board 600 by using solder when the connector 100 is mounted on and fixed to the circuit board 600. The fixed portion 480 is formed with a protrusion 482 protruding in the positive Y-direction. The protrusion 482 of the fixed portion 480 is received into the ditch of the alignment portion 210 so that a movement of the fixed portion 480 in the Y-direction is regulated. In other words, the contact 400 is partially held by the stationary housing 200. As can be seen from FIG. 6, the held portions 410 are movable together with the movable housing 300. In detail, when the movable housing 300 is moved in the XY-plane under a state where the fixed portions 480 are fixed to the circuit board 600, the housing support springs 470 are resiliently deformed so that the held portions 410 are moved together with the movable housing 300.

As can be seen from FIGS. 7 and 8, the held portion 410 according to the present embodiment has a first planar portion 420, two first sets each including two first press-fit portions 422, two second planar portions 430, two second sets each including two second press-fit portions 432, and two coupling portions 440. The first planar portion 420 is perpendicular to the Y-direction and in parallel with the XZ-plane. The two first sets are arranged along the Z-direction, or arranged vertically. In detail, a pair of the first press-fit portions 422 located at the positive Z-side (upper side) constitute one of the first sets while another pair of the first press-fit portions 422 located at the negative Z-side (lower side) constitute a remaining one of the first sets.

The two first press-fit portions 422 included in each of the first sets protrude oppositely to each other in the X-direction from the first planar portion 420. Each of the first press-fit portions 422 according to the present embodiment is a so-called press-fit protrusion (also called barb or wedge) which is formed to protrude. More specifically, the first press-fit portion 422 according to the present embodiment has an arrow feather shape with an angular portion of a right angle or an acute angle. In the present embodiment, a protruding amount of the first press-fit portion 422 located at the negative Z-side (lower side) is more than another protruding amount of the first press-fit portion 422 located at the positive Z-side (upper side). Each of the second planar portions 430 is coupled with the first planar portion 420 by the corresponding coupling portion 440. Each of the second planar portions 430 is perpendicular to the X-direction and in parallel with the YZ-plane. In other words, the coupling portion 440 couples the first planar portion 420 and the second planar portion 430 with each other so that the first planar portion 420 and the second planar portion 430 are perpendicular to each other. The coupling portion 440 not only prevents a stress applied to the first planar portion 420 from being transmitted to the second planar portion 430 but also prevents another stress applied to the second planar portion 430 from being transmitted to the first planar portion 420. The second sets are formed on the second planar portions 430, respectively. In other words, each of the second planar portions 430 is formed with a pair of the second press-fit portions 432 which constitute the second set. From another point of view, the second set is formed on the contact support spring 460. In other words, each of the contact support springs 460 is provided with the contact portion 450 and one or more of the second sets. The two second press-fit portions 432 included in each of the second sets protrude oppositely to each other in the Y-direction from the corresponding second planar portion 430. Each of the second press-fit portions 432 according to the present embodiment is also a so-called press-fit protrusion (also called barb or wedge). As can be seen from FIGS. 6 and 7, the first press-fit portions 422 and the second press-fit portions 432 of the held portion 410 are press-fit in the holder 310 of the movable housing 300. Accordingly, the first press-fit portions 422 and the second press-fit portions 432 are held by the movable housing 300.

As previously described, the held portion 410 according to the present embodiment is located between the two types of springs, namely, the contact support springs 460 and the housing support spring 470, to receives various forces directed in various directions. However, since the held portion 410 has the first press-fit portions 422 protruding oppositely to each other in the X-direction and the second press-fit portions 432 protruding oppositely to each other in the Y-direction, the held portion 410 is kept to be securely held by the holder 310. Accordingly, the held portion 410 is prevented from being loosely held by the holder 310 and is prevented from coming off the holder 310.

Although the held portion 410 according to the aforementioned embodiment has the two first sets each of which includes the two first press-fit portions 422, the present invention is not limited thereto. For example, the held portion 410 may have only one of the first sets. Moreover, although the held portion 410 has the only one second set, which includes the two second press-fit portions 432, in each of the second planar portions 430, the present invention is not limited thereto. For example, each of the second planar portions 430 may be provided with two or more of the second sets. In other words, the contact 400 may have one or more first sets and one or more second sets.

Although the first planar portion 420 and the second planar portion 430 according to the aforementioned embodiment are coupled with each other by the coupling portion 440 to be perpendicular to each other, the present invention is not limited thereto. For example, the first planar portion 420 and the second planar portion 430 may be provided to be in parallel with each other. In this case, the coupling portion 440 may be omitted. Moreover, in this case, the first press-fit portions 422 or the second press-fit portions 432 may be formed of, for example, protrusions. Alternatively, the first planar portion 420 may be partially cut and bent in a direction intersecting the first planar portion 420 in order to form the first press-fit portions 422. Similarly, the second planar portion 430 may be partially cut and bent in a direction intersecting the second planar portion 430 in order to form the second press-fit portions 432.

Although each of the first press-fit portions 422 and the second press-fit portions 432 according to the aforementioned embodiment is the press-fit protrusion, the present invention is not limited thereto. For example, each of the first press-fit portions 422 and the second press-fit portions 432 may be formed of an embossed protrusion. However, because the press-fit protrusion securely bites the housing (movable housing) 300 in comparison with the embossed protrusion, the held portion 410 provided with the press-fit protrusions is more securely held by the holder 310.

Although the contact 400 according to the aforementioned embodiment has the two contact support springs 460 each provided with the contact portion 450, the present invention is not limited thereto. For example, the contact 400 may have only one of the contact support springs 460 (see structure of a contact 400A shown in FIG. 9).

Although the connector 100 according to the aforementioned embodiment has the so-called floating structure, the present invention is not limited thereto. The concept about the held portion 410 according to the present embodiment is also applicable to a contact of a connector which does not have floating structure.

Figure 9:
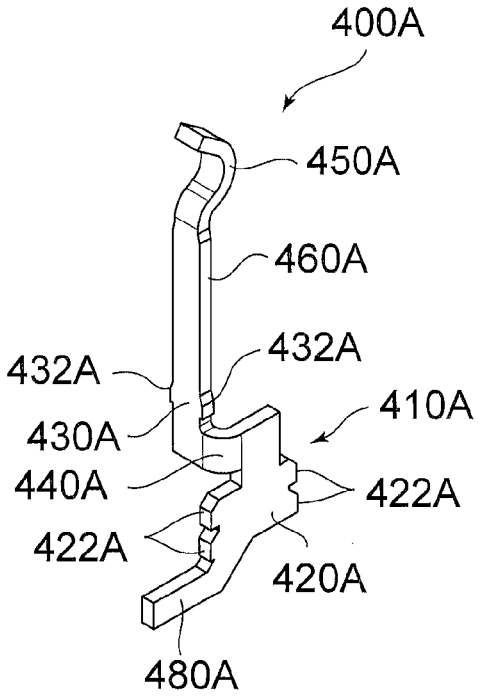
FIG. 9 is a perspective view showing a contact according to a modification.
Figure 10:
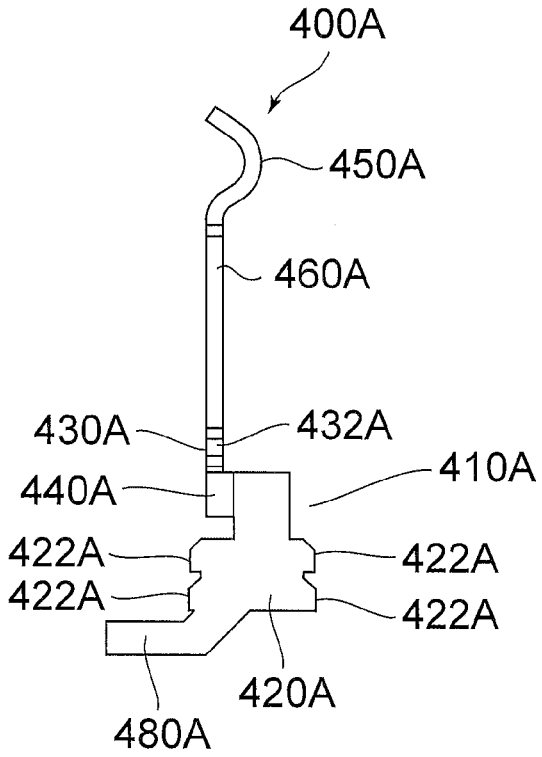
FIG. 10 is a front view showing the contact of FIG. 9.
Figure 11:
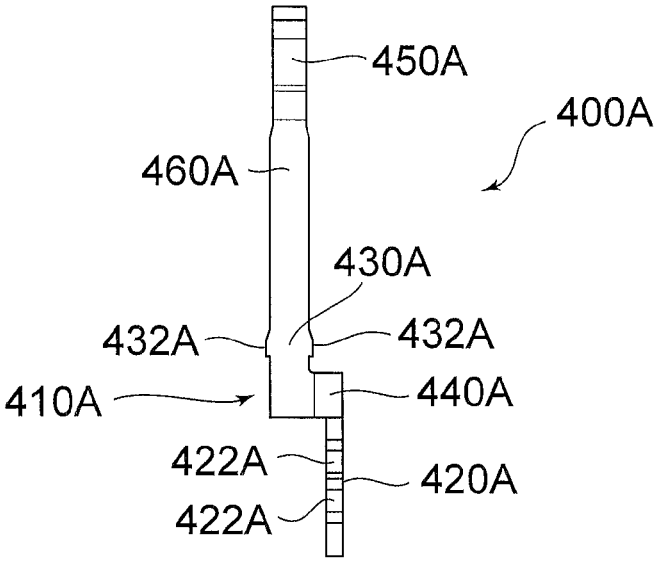
FIG. 11 is a side view showing the contact of FIG. 9.
Figure 12:
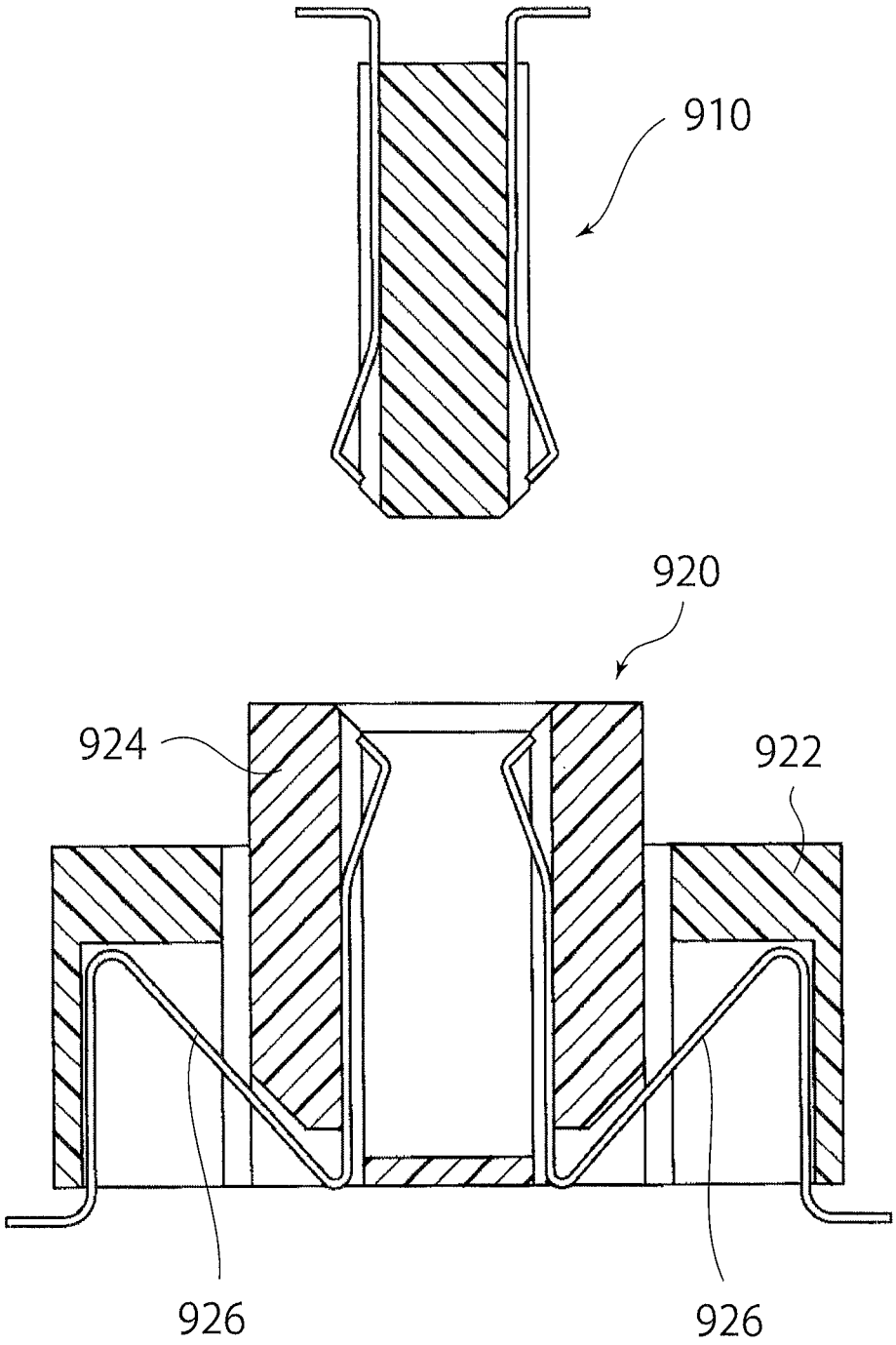
FIG. 12 PRIOR ART
FIG. 12 is a cross-sectional view showing a first connector and a second connector of Patent Document 1.

Hereafter, as referring to FIGS. 9 to 11, explanation is made about the contact 400A of a connector (not shown) which does not have floating structure. The contact 400A is a modification of the contact 400 (see FIGS. 7 and 8) according to the present embodiment. As shown in FIGS. 9 to 11, the contact 400A has a held portion 410A, a contact support spring 460A extending from the held portion 410A, a contact portion 450A supported by the contact support spring 460A and a fixed portion 480A extending from the held portion 410A. The held portion 410A is located between the fixed portion 480A and the contact support spring 460A.

The held portion 410A has a first planar portion 420A, two first sets each including two first press-fit portions 422A, a second planar portion 430A, a second set including two second press-fit portions 432A, and a coupling portion 440A. The held portion 410A is provided with the single first planar portion 420A and the single second planar portion 430A. The first planar portion 420A and the second planar portion 430A is perpendicular to each other. The two first press-fit portions 422A of each of the first sets protrude oppositely to each other from the first planar portion 420A. The two second press-fit portions 432A of the second set protrude oppositely to each other from the second planar portion 430A. The protruding direction of the first press-fit portions 422A is perpendicular to the protruding direction of the second press-fit portions 432A. Accordingly, when the contact 400A with this structure is press-fit into a housing (not shown), the housing does not loosely hold the contact 400A even if various stresses along various directions are applied to the contact 400A. Moreover, because a stress applied to the housing is hardly transmitted to the fixed portion 480A even under a state where the fixed portion 480A is fixed to a circuit board (not shown) by using solder, the solder is prevented from being cracked.

In the aforementioned embodiments, the two press-fit protrusions included in the first set, namely, the two first press-fit portions 422 or the two first press-fit portions 422A, have the same shape as each other. Similarly, the two press-fit protrusions included in the second set, namely, the two second press-fit portions 432 or the two second press-fit portions 432A, have the same shape as each other. However, the present invention is not limited thereto. The two press-fit protrusions included in the first set may have different shapes from each other. Similarly, the two press-fit protrusions included in the second set may have different shapes from each other. In other words, the press-fit protrusions that constitute a pair may have different shapes from each other.

The present application is based on a Japanese patent application of JP2013-164567 filed before the Japan Patent Office on Aug. 7, 2013, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising a stationary housing, a movable housing and a plurality of contacts, wherein:

each of the contacts has one or more first sets and one or more second sets;

the first set includes two first press-fit portions which protrude oppositely to each other in a first direction;

the second set includes two second press-fit portions which protrude oppositely to each other in a second direction perpendicular to the first direction;

the first press-fit portions and the second press-fit portions are press-fit in the housing;

the connector is to be mounted on a circuit board;

the movable housing is movable relative to the stationary housing;

the first press-fit portions and the second press-fit portions are held by the movable housing;

each of the contacts has a fixed portion and a housing support spring partially held by the stationary housing;

the housing support spring extends from the fixed portion; and the fixed portion is fixed to the circuit board when the connector is mounted on the circuit board.

2. The connector as recited in claim 1, wherein each of the first press-fit portions and the second press-fit portions is a press-fit protrusion.

3. The connector as recited in claim 1, wherein:

each of the contacts has a first planar portion, a second planar portion and a coupling portion;

the first planar portion is perpendicular to the second direction;

the second planar portion is perpendicular to the first direction;

the coupling portion couples the first planar portion and the second planar portion with each other;

the first press-fit portion protrudes from the first planar portion in the first direction; and the second press-fit portion protrudes from the second planar portion in the second direction.

4. The connector as recited in claim 1, wherein:

each of the contacts has two contact support springs;

each of the two contact support springs is provided with a respective contact portion and with one or more of the second sets; and the contact portions face each other in the first direction.

* * * * *